US009448579B2

(12) United States Patent
Marinca

(10) Patent No.: US 9,448,579 B2
(45) Date of Patent: Sep. 20, 2016

(54) LOW DRIFT VOLTAGE REFERENCE

(71) Applicant: Analog Devices Global, Hamilton (BM)

(72) Inventor: Stefan Marinca, Limerick (IE)

(73) Assignee: Analog Devices Global, Hamilton (BM)

( * ) Notice: Subject to any disclaimer, the term of this patent is extended or adjusted under 35 U.S.C. 154(b) by 69 days.

(21) Appl. No.: 14/136,774

(22) Filed: Dec. 20, 2013

(65) Prior Publication Data

US 2015/0177771 A1 Jun. 25, 2015

(51) Int. Cl.
*G05F 3/18* (2006.01)

(52) U.S. Cl.
CPC ..... *G05F 3/185* (2013.01)

(58) Field of Classification Search
CPC ..... G05F 3/18; G05F 3/20; G05F 3/22; G05F 3/30; G05F 3/222; G05F 3/225
USPC ..... 323/313–316, 907; 327/534–546
See application file for complete search history.

(56) References Cited

U.S. PATENT DOCUMENTS

| | | | | |
|---|---|---|---|---|
| 3,671,770 | A * | 6/1972 | Frederiksen | 327/513 |
| 4,283,674 | A * | 8/1981 | Kominami et al. | 323/313 |
| 4,352,056 | A * | 9/1982 | Cave et al. | 323/314 |
| 4,588,940 | A * | 5/1986 | Embree et al. | 323/313 |
| 4,636,710 | A * | 1/1987 | Stanojevic | 323/280 |
| 4,785,230 | A * | 11/1988 | Ovens et al. | 323/313 |
| 4,899,152 | A * | 2/1990 | Barrow et al. | 341/154 |
| 5,243,239 | A * | 9/1993 | Khan et al. | 327/553 |
| 5,252,908 | A * | 10/1993 | Brokaw | 323/313 |
| 5,347,224 | A * | 9/1994 | Brokaw | 324/522 |
| 6,046,578 | A * | 4/2000 | Feldtkeller | 323/314 |
| 6,188,059 | B1 * | 2/2001 | Nishiyama et al. | 250/214 R |
| 6,307,426 | B1 * | 10/2001 | Ricotti et al. | 327/543 |
| 6,381,491 | B1 * | 4/2002 | Maile et al. | 607/2 |
| 6,799,889 | B2 * | 10/2004 | Pennock | 374/178 |
| 2003/0004666 | A1 * | 1/2003 | Matsumura et al. | 702/100 |
| 2004/0062292 | A1 * | 4/2004 | Pennock | 374/170 |
| 2005/0012493 | A1 * | 1/2005 | Rosenthal | 323/313 |
| 2005/0046406 | A1 * | 3/2005 | Menegoli et al. | 323/313 |
| 2006/0001413 | A1 * | 1/2006 | Marinca | 323/315 |
| 2006/0255854 | A1 * | 11/2006 | Ahuja et al. | 327/541 |

(Continued)

FOREIGN PATENT DOCUMENTS

| | | | |
|---|---|---|---|
| CN | 1497248 | A | 5/2004 |
| CN | 201548864 | U | 8/2010 |
| CN | 201936216 | U | 8/2011 |

OTHER PUBLICATIONS

Linear Technology, "Ultra Precision Reference", LTZ1000/LTZ1000A Datasheet, Rev. D, Apr. 2012, 8 pages.

"Chinese Application Serial No. 201410797934.2, Response filed Apr. 18, 2016 to Office Action mailed Dec. 3, 2003", Without English Translation, 9 pgs.

Chinese Application Serial No. 201410797934.2, Office Action mailed Jul. 20, 2016, (w/ English Translation, 10 pgs.

*Primary Examiner* — Timothy J Dole
*Assistant Examiner* — Yusef Ahmed
(74) *Attorney, Agent, or Firm* — Schwegman Lundberg & Woessner, P.A.

(57) ABSTRACT

Circuits and method for providing voltage reference circuits that include low drift over time and lower operating voltages are provided. Generally, it is desirable that a reference circuit provide an accurate and precise reference over time. The voltage reference circuits described can provide for good long term stability, operation at lower voltages than prior designs, consistent output voltage with reduced variability due to process changes and mismatches, low noise in the reference voltage, and other advantages.

20 Claims, 6 Drawing Sheets

(56) References Cited

U.S. PATENT DOCUMENTS

2008/0224759 A1* 9/2008 Marinca ..... 327/539
2009/0058391 A1* 3/2009 Rokos ..... 323/313
2009/0189683 A1* 7/2009 Wu ..... 327/543
2010/0001711 A1* 1/2010 Marinca ..... 323/313
2012/0092064 A1* 4/2012 Floyd ..... 327/543

* cited by examiner

LOW DRIFT VOLTAGE REFERENCE

FIELD

The present disclosure relates to a method and apparatus for generating a voltage that can be used as a reference in a system such as an integrated circuit.

BACKGROUND

A voltage reference is typically provided by electronic circuitry that provides at an output of the circuitry a constant voltage that does not fluctuate even when there are variations in temperature or the power supply that might normally or otherwise cause fluctuations in the voltage. As a result, the hope is that the voltage reference can provide a point of reference even as conditions in the system can vary. Voltage references can be used in power supply voltage regulators, analog-to-digital converters, digital-to-analog converters as well as many other measurement and control systems. Generally, a voltage reference can be created by balancing a voltage that increases with temperature increases with a voltage that decreases with temperature increases.

A voltage that is proportional to absolute temperature (PTAT) increases with temperature increases and is known as a PTAT voltage. A voltage that is complementary to absolute temperature (CTAT) can decrease with temperature decreases and is known as a CTAT voltage. A voltage reference can be based on a bandgap principle where a transistor base-emitter voltage, which is intrinsically complementary to absolute temperature, CTAT, is added to a voltage which is proportional to absolute temperature, PTAT. If the two voltage components are well balanced the compound voltage is at a first order compensated against temperature variations. The problem with traditional voltage references is related to instability of the reference over time. This instability is known as drift and is mainly attributed to the CTAT voltage component. This has an absolute magnitude and is dependent on many process parameters.

There is therefore a continued desire for a stable voltage reference that has reduced drift characteristics.

SUMMARY

These and other problems are addressed by a voltage reference provided in accordance with the present teaching which reduces drift by combining a zener diode with a CTAT component. The zener diode output has an intrinsic PTAT form which when combined with a CTAT component, generated by a negative base emitter voltage difference resultant from combining multiple bipolar transistors operating at different collector current densities, can provide a compound voltage which is at a first order compensated against temperature variations. By using a zener diode, which provides a very stable voltage as an output, it is possible to generate a voltage reference that has very low drift characteristics.

BRIEF DESCRIPTION OF THE DRAWINGS

Embodiments which are provided to assist with an understanding of the present teaching will now be described, by way of example, with reference to the accompanying drawings, in which.

DETAILED DESCRIPTION

The present teaching provides a low drift voltage references formed from a compound voltage resultant from combining a PTAT component with a CTAT component. The PTAT component is desirably generated by biasing a zener diode with bias current. As a result the output of the zener diode has a PTAT form that will increase with increases in absolute temperature. To compensate for this increase in the output of the zener diode with increases in temperature, the present teaching combines this PTAT component with a CTAT component. The CTAT component is generated by a negative base emitter voltage difference resultant from combining multiple bipolar transistors operating at different collector current densities. It is known that the base emitter voltage difference between two such transistors has a PTAT form, BUT what is provided by the present teaching is an inverted or negative base emitter voltage difference which has a CTAT form.

Figure 1:
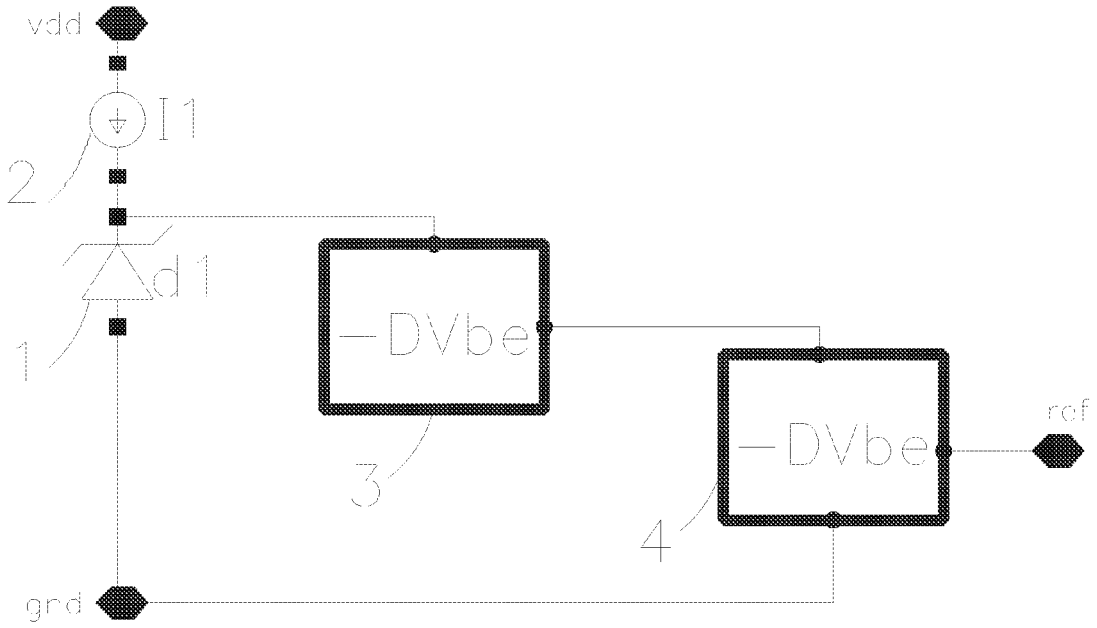
FIG. 1 is a schematic showing components of an illustrative circuit provided in accordance with the present teaching.

FIG. 1 shows an example of such a voltage reference circuit. It comprises a zener diode, 1, biased from a bias current, I1. The zener diode is desirably fabricated as a buried zener. As will be appreciated by those of ordinary skill, a buried zener diode exhibits very low noise characteristics and is very stable over time and temperature.

This high performance PTAT voltage component is combined with multiple negative base-emitter voltage difference blocks or cells, 3 to 4, which provide a CTAT voltage component of the circuit. By combining the PTAT voltage contribution from the zener diode with the CTAT voltage contribution from the multiple negative base-emitter voltage difference (−ΔVbe) blocks, the circuit provides at an output, ref, a stable voltage reference which is to a first order temperature insensitive. As the CTAT component is provided by a differential between the output of two or more circuit elements, the CTAT component does not have an absolute magnitude and is therefore very stable over time and temperature.

Figure 2:
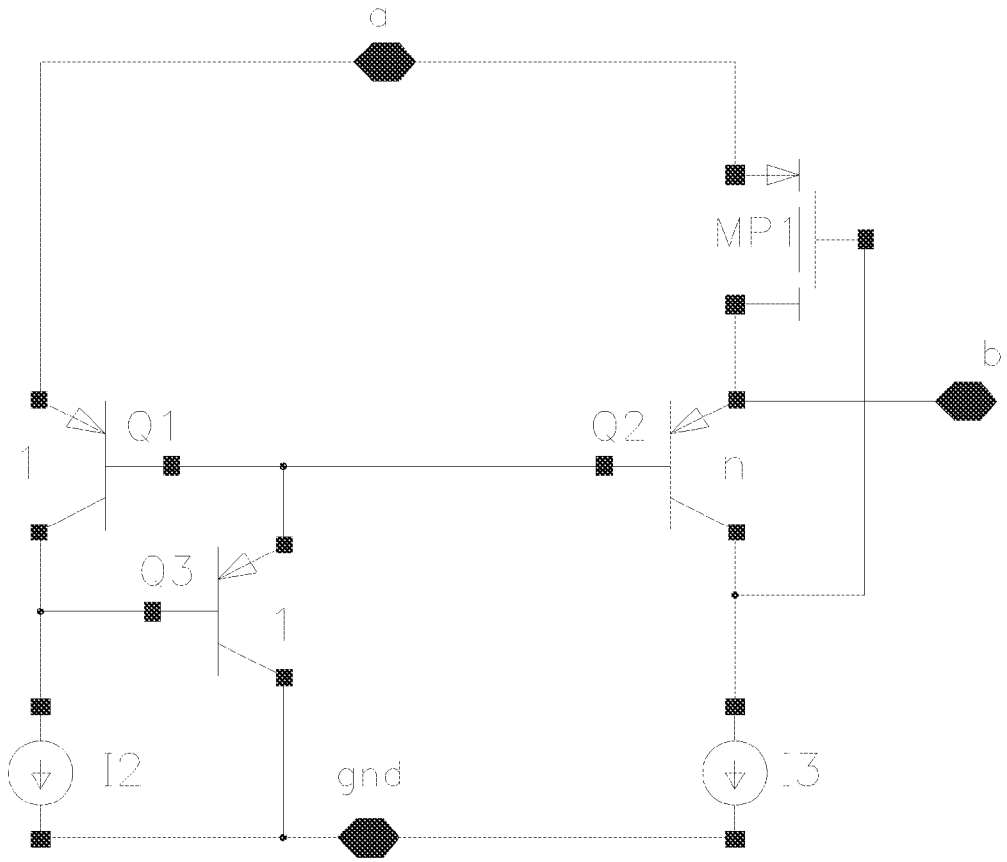
FIG. 2 is a schematic showing exemplary components of a circuit that may be used to generate a base-emitter voltage difference for use with the circuit of FIG. 1.

One implementation of how such a base-emitter voltage difference may be generated is shown in FIG. 2. It will be understood that where FIG. 1 shows two −ΔVbe cells, 3, 4 that each of these cells may be fabricated per a circuit configuration such as shown in FIG. 2. Two PNP bipolar transistors, Q1, Q2, are biased with two corresponding collector currents, I2, I3, such that Q1 and Q2 are operating at different collector current densities. One way to impose this collector current density difference is to have similar bias currents (I2=I3) but provide Q1 and Q2 having different emitter areas. For example, and as shown, Q1 can be provided as a unity emitter bipolar transistor and Q2 as a "n" times unity emitter bipolar transistor. A third transistor Q3 is provided and is coupled to the collector and base of Q1. This configuration serves to minimize the impact of the base current. The difference in base-emitter voltage of Q1 to Q2 is reflected across a PMOS transistor MP1, from the nodes, "a" and "b" as:

$$\Delta V_{be} = V_a - V_b = \frac{kT}{q}\ln(n) \quad (1)$$

Here k is Boltzmann's constant, T is absolute temperature in K, and q is the electron charge.

According to equation (1) the voltage difference from the nodes "a" and "b" in FIG. 2 drops as temperature increases such that it is of a CTAT form. It will be appreciated that node "a" of this cell is coupled between the bias current I1 and the zener d1 of FIG. 1. The node "b" provides an input to a second cell which would have its node "a" coupled to node "b" of the first cell. The node "b" of the second cell would then provide the voltage reference of the overall circuit. This cascading of multiple cells could be replicated.

Figure 3:
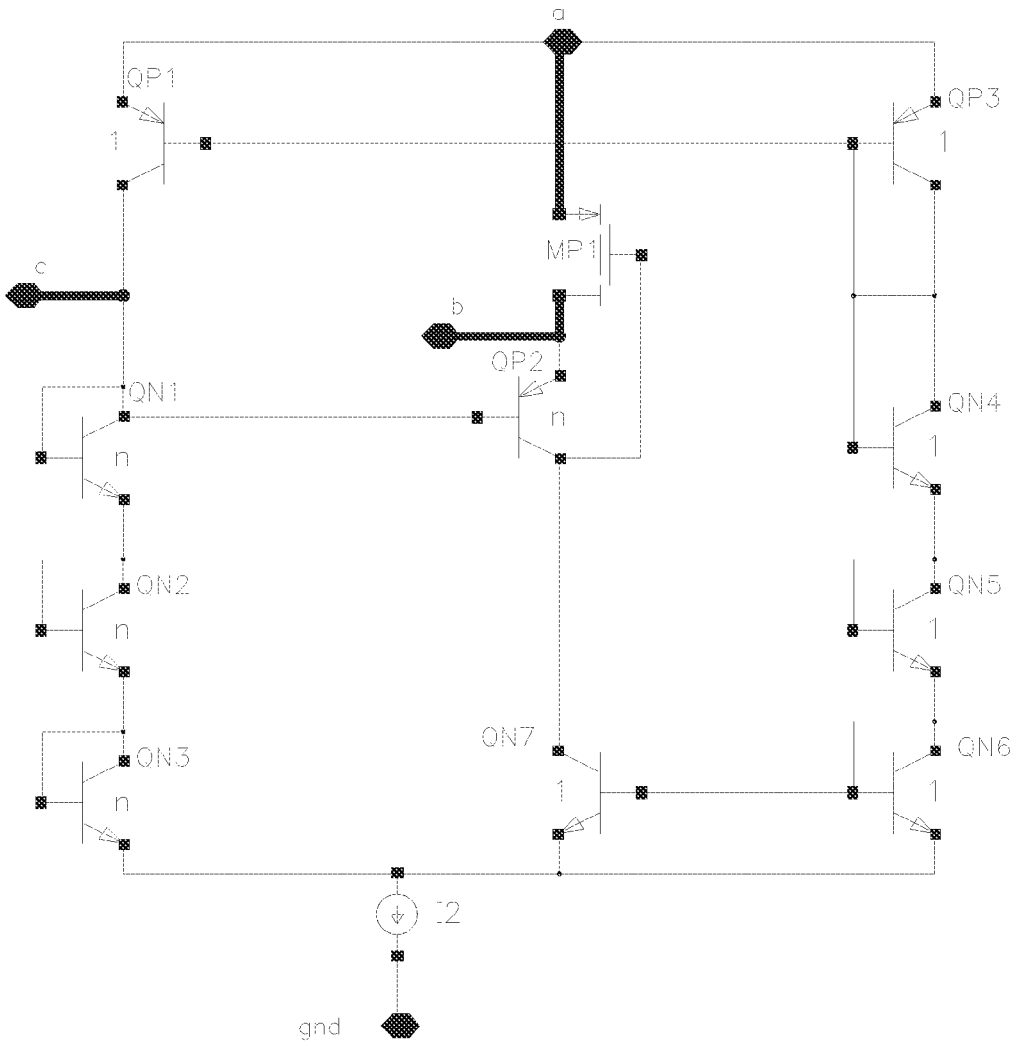
FIG. 3 is a schematic showing exemplary components of a circuit that may be used to generate a base-emitter voltage difference for use with the circuit of FIG. 1

FIG. 3 shows another implementation of a −ΔVbe cell which can be used to generate the −ΔVbe component for use with the circuit of FIG. 1. The circuit elements of FIG. 3 by themselves generate a PTAT output BUT by coupling this cell across the zener diode, it may be used to flatten the overall PTAT temperature coefficient characteristics of the zener diode. In the arrangement of FIG. 3, and similarly to FIG. 2, by judiciously combining circuit elements in such a −ΔVbe cell to the zener diode, it is possible to generate a large voltage difference from the nodes "a" and "b" which serves to flatten the PTAT TC of the zener.

Similarly to FIG. 2, the node "a" of this cell is coupled to a top plate of the zener—between the bias current I1 and the zener d1 of FIG. 1. The node "b" of this cell is operably coupled to a corresponding node "a" of a similar cell—where two or more such cells or cascaded to provide multiple −ΔVbe components to balance the positive temperature coefficient response of the zener diode. The node "b" of the final cell of such a cascaded arrangement provides the output node of the overall circuit, the voltage reference node.

In the circuit of FIG. 3, the circuit elements of the −ΔVbe cell are coupled to a single biasing current. Desirably, the circuit elements comprise bipolar transistors and, by avoiding the need for a second current source to drive the bipolar transistors of the cell, the present teaching avoids problems associated with mismatch.

As shown in FIG. 3, the cell consists of three parallel arms which are coupled to a single bias current I2. The configuration is such that the bias current I2 is divided in three equal currents. The first arm comprises a PNP bipolar transistor QP1 (used as current mirror), and three NPN diode connected bipolar transistors QN1, QN2, QN3, operating at low collector current density. The second arm comprises a PMOS transistor, MP1, a PNP bipolar transistor operating at low collector current density, QP2, and QN7 (used as current mirror). The third arm comprises four bipolar transistors which are provided in a diode connected configuration and which operate at high collector current density, a PNP bipolar transistor, QP3, and three NPN bipolar transistors, QN4, QN5, QN6. The cell operates such that whatever the current in the third arm is it is mirrored via QP3 to QP1 in the first arm and via QN6 to QN7 from the third arm to the second arm.

Using such a configuration it will be evident that across MP1, source to drain, a voltage of the form of four base-emitter voltage differences (ΔVbe) is developed (one from QP3 to QP2, one from QN1 to QN4, one from QN2 to QN4, one from QN3 to QN6).

While a ΔVbe is inherently of a PTAT form, by providing an inverted ΔVbe it has a CTAT form and can therefore be considered a CTAT component of the overall circuit. It will be appreciated that each of the CTAT components provided by the −ΔVbe circuitry and the PTAT component provided by the buried zener have an associated temperature coefficient, TC. The overall reference voltage temperature coefficient is a combination of the two. Given the fact that a typical voltage for a buried zener voltage at ambient temperature is ~5.3V, it will be appreciated that a scaling of this reference voltage temperature coefficient is optimally achieved by modifying the scalar value of the CTAT components.

In one exemplary aspect, the reference voltage temperature coefficient can be adjusted digitally via a Digital to Analog Converter (DAC). One way to adjust temperature coefficient is to add or subtract a digitally controlled current in the cell of FIG. 3 at the node "c". If a bias current (assumed to have the same temperature dependency as I2 of FIG. 3) is injected at the node "c" the collector current density ratio of QN1 to QN3 relative to QN4 to QN6 increases which results in an increase of base-emitter voltage difference from the nodes "a" and "b". If a bias current of a similar form is subtracted from the node "c" the corresponding base-emitter voltage difference decreases. If two such cells are provided, each generating a −ΔVbe, then the trimming current can be introduced into each of the cells. This serves to broaden the actual range of trimming that may be achieved.

In a similar fashion, different combinations of −ΔVbe cells can be used to generate an appropriate negative PTAT voltage in order to compensate for the temperature variation of the buried zener diode.

A circuit according to FIG. 1 and FIG. 3 was designed and simulated. The temperature coefficient of the zener diode of FIG. 1 was compensated via a cascade of two circuits or cells according to FIG. 3.

Figure 4:
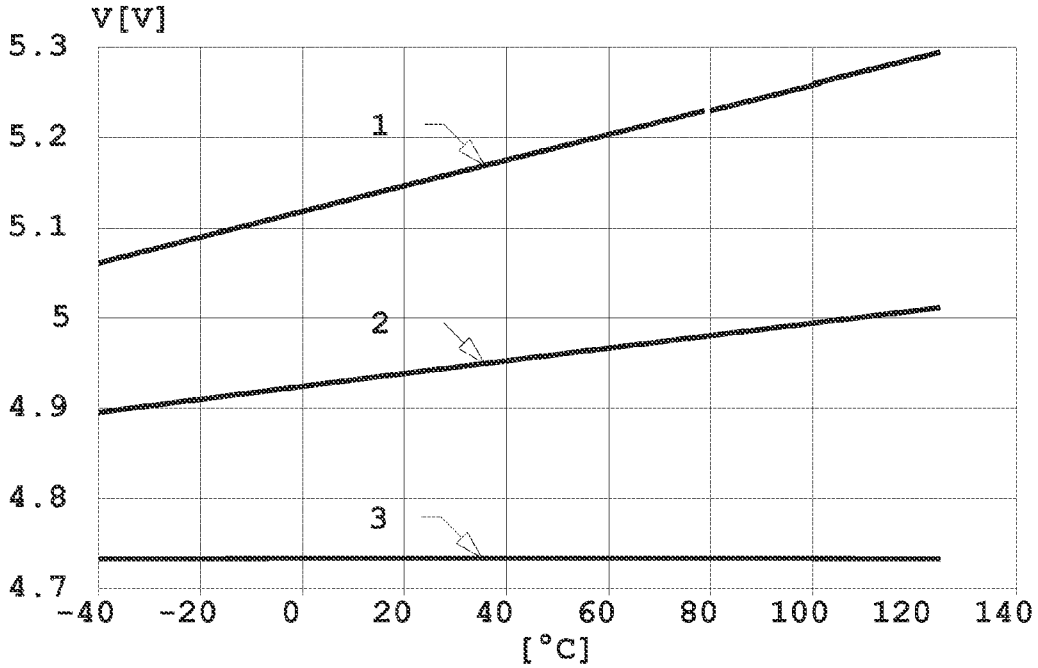
FIG. 4 is a graph showing simulation data of a circuit provided in accordance with the present teaching.

FIG. 4 shows simulation data for the voltage drop across zener diode, 1, after the contribution from a first base-emitter voltage difference block, 2, and at the output of the second base-emitter voltage difference block 3. It will be seen that the predominately PTAT output of the zener shown as line 1 is reduced to a substantially flat response across a wide temperature range by combining multiple −ΔVbe components. As discussed above, the actual response characteristics of this voltage reference may be further optimised by trimming the circuit. Such trimming may be achieved by adding in or subtracting out a trimming current. It will be appreciated that trimming currents allow a fine tuning of the response characteristics of the circuit. One particularly advantageous node to select for introduction of the trimming current (be that an adding or subtracting of that current) is the node "c" in the first arm of the cell shown in FIG. 3.

Figure 5:
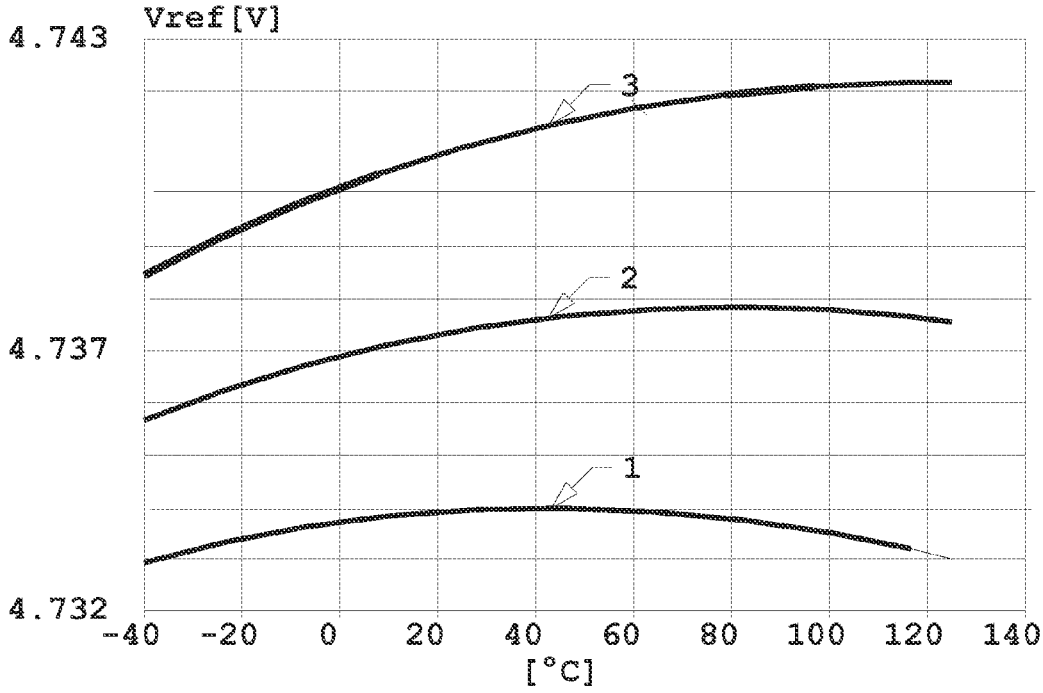
FIG. 5 is a graph showing simulation data of how the use of trimming currents may be used to optimise the circuit of FIG. 1.

FIG. 5 shows simulation data of how the introduction of such a trimming current may be used to fine tune the temperature coefficient response characteristics of the voltage reference provided at the output of the circuit. In the simulation data presented in FIG. 5, the line 2 corresponds to the line 3 of FIG. 4, i.e. a non-trimmed voltage reference. By adding a small trimming current, of the order of 1 LSB, to the node "c" of FIG. 3, the output voltage increases in both absolute value and temperature coefficient—shown as line 3 in FIG. 5. Similarly, if the same LSB current is subtracted from the node "c" the voltage variation corresponds to line 1 of FIG. 5. It will be appreciated from the scale of FIG. 5, such an arrangement provides for a fine tuning of an already compensated PTAT output from the zener diode.

Figure 6:
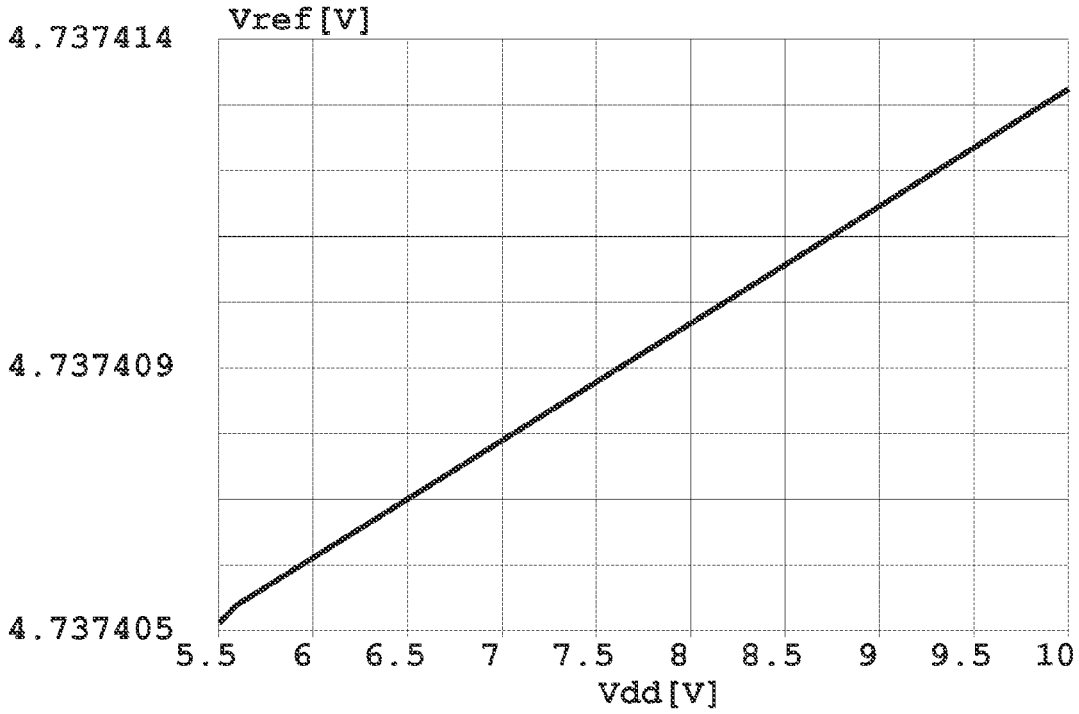
FIG. 6 is a graph showing simulation data of the performance of a circuit provided in accordance with the present teaching at 25° C. with the supply voltage changed from 10V to 5.5V.

The necessary supply voltage for a voltage reference circuit such as shown in FIG. 1 is mainly dictated by the supply requirements of the zener diode. This will typically require a supply voltage of the order of at least 5.5V. FIG. 6 shows how varying this supply voltage from 5.5V to 10V has little effect on the overall output of the circuit, i.e. the circuit exhibits very stable response characteristics.

It will be appreciated that a circuit such as that described with reference to FIG. 1 can be stacked or cascaded to generate larger output voltages. For example, for a stack of two compensated zener diodes according to FIG. 1 and multiple cells per FIG. 3, a double reference voltage can be generated. In a similar fashion more cells can be stacked and larger reference voltages can be generated. It will be appreciated that each stacked zener will desirably require a plurality of individual circuit elements, configured to generate multiple $-\Delta Vbe$ contributions to the compound voltage that defines the voltage reference of the circuit.

In other configurations the reference voltage can be scaled up or down using a divider or amplifier. It is understandable that the reference voltage according to the present disclosure can used with or without die temperature control. If the die temperature is controlled a very stable voltage against temperature variation can be achieved. It will be appreciated that such an arrangement may require provision of a larger supply current to heat the die.

It will be appreciated that circuits provided in accordance with the present teaching provide a number of advantages including:

- Very good long term stability as there are no absolute voltage components other than zener diode itself;
- The reference voltage can be supplied from low voltage of ~5.5V compared to the traditional buried zener which need about one volt more;
  - the output voltage is very consistent with reduced variability due to the process change and mismatches;
  - low noise;
  - self compensating CTAT component;
  - high power supply rejection ratio, PSRR; and
  - very low non-linearity.

It is however not intended to limit the present teaching to any one set of advantages or features as modifications can be made without departing from the spirit and or scope of the present teaching.

The systems, apparatus, and methods of providing a voltage reference are described above with reference to certain embodiments. A skilled artisan will, however, appreciate that the principles and advantages of the embodiments can be used for any other circuits, apparatus, or methods with a need for a temperature insensitive output.

Additionally, while the $-\Delta Vbe$ voltages have been described with reference to the use of specific types of bipolar transistors any other suitable transistor or transistors capable of providing base-emitter voltages could equally be used within the context of the present teaching. It is envisaged that each single described transistor may be implemented as a plurality of transistors, the base-emitters of which would be connected in parallel. For example, where circuits in accordance with the present teaching are implemented in a CMOS process, each transistor may be implemented as a plurality of bipolar substrate transistors each of unit area, and the areas of the transistors in each of the arms would be determined by the number of bipolar substrate transistors of unit area connected with their respective base-emitters in parallel.

In general, where the circuits according to the present teaching are implemented in a CMOS process, the transistors will be bipolar substrate transistors, and the collectors of the transistors will be held at ground, although the collectors of the transistors may be held at a reference voltage other than ground.

Such circuits and cells can be provided as systems, apparatus, and/or methods that can be implemented in various electronic devices. Examples of the electronic devices can include, but are not limited to, consumer electronic products, parts of the consumer electronic products, electronic test equipment, wireless communications infrastructure, etc. Examples of the electronic devices can also include circuits of optical networks or other communication networks, and disk driver circuits. The consumer electronic products can include, but are not limited to, measurement instruments, medical devices, wireless devices, a mobile phone (for example, a smart phone), cellular base stations, a telephone, a television, a computer monitor, a computer, a hand-held computer, a tablet computer, a personal digital assistant (PDA), a microwave, a refrigerator, a stereo system, a cassette recorder or player, a DVD player, a CD player, a digital video recorder (DVR), a VCR, an MP3 player, a radio, a camcorder, a camera, a digital camera, a portable memory chip, a washer, a dryer, a washer/dryer, a copier, a facsimile machine, a scanner, a multi-functional peripheral device, a wrist watch, a clock, etc. Further, the electronic device can include unfinished products.

Unless the context clearly requires otherwise, throughout the description and the claims, the words "comprise," "comprising," "include," "including," and the like are to be construed in an inclusive sense, as opposed to an exclusive or exhaustive sense; that is to say, in the sense of "including, but not limited to." The words "coupled" or "connected", as generally used herein, refer to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the Detailed Description using the singular or plural number may also include the plural or singular number, respectively. The words "or" in reference to a list of two or more items, is intended to cover all of the following interpretations of the word: any of the items in the list, all of the items in the list, and any combination of the items in the list. All numerical values provided herein are intended to include similar values within a measurement error.

The teachings of the inventions provided herein can be applied to other systems, not necessarily the systems described above. The elements and acts of the various embodiments described above can be combined to provide further embodiments. The act of the methods discussed herein can be performed in any order as appropriate. Moreover, the acts of the methods discussed herein can be performed serially or in parallel, as appropriate.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. Accordingly, the scope of the present inventions is defined by reference to the claims.

What is claimed is:

1. A voltage reference circuit comprising:

a zener diode, including an anode, a cathode, and a positive temperature coefficient for a voltage generated between the anode and the cathode; and a temperature compensation circuit, connected to the cathode of the zener diode, configured to provide a temperature stable output voltage reference by subtracting from the voltage at the cathode of the zener diode, a series of base-emitter voltage differences respectively provided by bipolar transistors having different emitter current densities, wherein the temperature compensation circuit includes a series of base-emitter voltage difference circuits to generate the series of base-emitter voltage differences, wherein a base emitter voltage difference circuit is arranged in a cell, the cell comprising: a plurality of bipolar transistors arranged in first, second and third arms of the cell and configured to generate a proportional to absolute temperature voltage at an output of the cell that is dependent on individual ones of the plurality of bipolar transistors, and wherein each of the first arm, second arm and third arms are coupled to a single bias current such that the bias current is divided into each of the arms and each of the arms compensates for base current variations in the other of the arms.

2. The voltage reference circuit of claim 1, wherein the temperature compensation circuit includes a series of base-emitter voltage difference circuits to generate the series of base-emitter voltage differences, wherein the series of base-emitter voltage difference circuits include a first negative base-emitter voltage differential, ΔVbe, block and a second negative base-emitter voltage differential, ΔVbe, block, the first block and second block being cascaded relative to one another.

3. The voltage reference circuit of claim 1 wherein the temperature compensation circuit includes a series of base-emitter voltage difference circuits to generate the series of base-emitter voltage differences, wherein a base-emitter voltage difference circuit includes a first bipolar transistor having a first emitter area and a second bipolar transistor having a second different emitter area, and wherein the voltage reference circuit further includes a MOS device coupled to each of the first bipolar transistor and the second bipolar transistor such that a base-emitter voltage difference between each of the first bipolar transistor and second bipolar transistor is reflected across the MOS device source and drain.

4. The voltage reference circuit of claim 3 further comprising a third bipolar transistor coupled to each of a base and a collector of the first bipolar transistor to minimize base current impact.

5. The voltage reference circuit of claim 1, wherein the proportional to absolute temperature voltage provided at the output of the cell is related to a base-emitter voltage difference, ΔVbe, generated from an emitter ratio of a first set of bipolar transistors operating at a first collector current density and a second set of bipolar transistors operating at a second, lower, collector current density, the cell being coupled to the zener diode so as to provide the ΔVbe as a negative ΔVbe contribution to balance positive temperature coefficient response characteristics of the zener diode.

6. The voltage reference circuit of claim 5 further comprising a MOS device and wherein the base-emitter voltage difference generated from the emitter area ratio is reflected across the MOS device source and drain to the output of the cell.

7. The voltage reference circuit of claim 1, wherein each arm comprises at least one transistor provided in a PNP configuration, the cell being configured such that emitters of individual PNP transistors of each of the first, second and third arms are coupled to a common node that is biased by the same bias current.

8. The voltage reference circuit of claim 7 wherein a first arm of the cell comprises a PNP transistor having a unity emitter size and a second arm of the circuit comprises a PNP transistor having a multiple, n, emitter size, the circuit being configured to generate a voltage at the output of the cell that is first order independent of the bias current and proportional to the multiple n.

9. The voltage reference circuit of claim 7 comprising a plurality of bipolar transistors configured in an NPN configuration and wherein each of a first arm and a second arm of the cell comprises at least one NPN configured transistor and at least one PNP configured transistor, the first arm operating at a first collector current density and the second arm operating at a second, lower, collector current density, the circuit being configured to generate a base emitter voltage difference at the output of the cell.

10. The voltage reference circuit of claim 9 wherein the NPN configured transistors have a different emitter area than the PNP configured transistors.

11. The voltage reference circuit of claim 1, wherein the bias current is provided by a current source coupled to a supply voltage of the circuit.

12. The voltage reference circuit of claim 1, wherein individual transistors of the third arm are provided in a diode connected configuration.

13. The voltage reference circuit of claim 1 further comprising a trimming node whereby a trimming current can be introduced into the circuit to vary the temperature coefficient characteristics of the circuit.

14. The voltage reference circuit of claim 13 wherein the trimming current is either added into the circuit or subtracted out of the circuit to vary the temperature coefficient characteristics of the circuit.

15. The voltage reference circuit of claim 14 wherein the trimming current is coupled to the circuit elements configured to generate a negative base-emitter voltage differential, ΔVbe, component.

16. The voltage reference circuit of claim 1, wherein the base-emitter voltage difference circuits are resistor-less.

17. A voltage reference circuit comprising:

a first set of circuit elements comprising a zener diode having a positive temperature coefficient for a voltage generated between an anode and a cathode of the zener diode;

a second set of circuit elements comprising a series of base-emitter voltage difference circuits that include ratiometrically scaled pairs of bipolar transistors configured to generate a-proportional to absolute temperate (PTAT) voltage, wherein a ratiometrically scaled pair of bipolar transistors includes a first bipolar transistor having a first emitter area and a second bipolar transistor having a second different emitter area scaled to the first emitter area; and the circuit coupling each of the first and second set of circuit elements to subtract the PTAT voltage from a voltage at the cathode of the zener diode to generate a temperature stable voltage reference at an output of the circuit, wherein the second set of circuit elements are arranged in a cell, the cell comprising: a plurality of bipolar transistors arranged in first, second and third arms of the cell and configured to generate a proportional to absolute temperature voltage at an output of the cell that is dependent on individual ones of the plurality of bipolar transistors, and wherein each of the first arm, second arm and third arms are coupled to a single bias current such that the bias current is divided into each of the arms and each of the arms compensates for base current variations in the other of the arms.

18. The voltage reference circuit of claim 17 wherein the proportional to absolute temperature voltage provided at the output of the cell is related to a base-emitter voltage difference, ΔVbe, generated from an emitter ratio of a first set of bipolar transistors operating at a first collector current density and a second set of bipolar transistors operating at a second, lower, collector current density, the cell being coupled to the first set of circuit elements so as to provide the ΔVbe as a negative ΔVbe contribution to the positive temperature coefficient response characteristics of the zener diode.

19. A method of providing a voltage reference comprising:

generating a series of base-emitter voltage differences respectively provided by bipolar transistors having different emitter current densities; and coupling a zener diode to the bipolar transistors, the bipolar transistors being configured to generate a negative base-emitter voltage differential having a complimentary to absolute temperature, CTAT, voltage form which compensates for a proportional to absolute temperature, PTAT, temperature coefficient of the zener diode to provide at an output of the circuit a voltage reference having a first order temperature insensitivity, wherein the generating the series of base-emitter voltage differences includes arranging a plurality of bipolar transistors in first, second and third arms of a cell and generating a proportional to absolute temperature voltage at an output of the cell that is dependent on individual ones of the plurality of bipolar transistors, and dividing a single bias current into each of the first, second and third arms of the cell such that each of the arms compensates for base current variations in the other of the arms of the cell.

20. A voltage reference circuit comprising a zener diode coupled to circuit elements configured to generate a negative base-emitter voltage differential, ΔVbe, component, the negative ΔVbe component compensating for positive temperature coefficient response characteristics of the zener diode to provide a voltage reference at an output of the voltage reference circuit, wherein:

the circuit elements are arranged in a cell, the cell comprising:

a plurality of bipolar transistors arranged in first, second and third arms of the cell and configured to generate a proportional to absolute temperature voltage at an output of the cell that is dependent on individual ones of the plurality of bipolar transistors, and each of the first arm, second arm and third arms are coupled to a single bias current such that the bias current is divided into each of the arms and each of the arms compensates for base current variations in the other of the arms, the circuit elements comprise:

a first PNP transistor having a unity emitter size;

a second PNP transistor having a multiple, n, emitter size;

a third PNP transistor having a unity emitter size; and a PMOS transistor, the first PNP transistor has its emitter connected to a positive supply node, its base connected to the base of the second PNP transistor and the emitter of the third PNP transistor, and its collector connected to the base of the third PNP transistor and a current source, the second PNP transistor has its emitter connected to an output node and the drain of the PMOS transistor, and its collector connected to a second current source and the gate of the PMOS transistor, the third PNP transistor has its collector coupled to ground, and the PMOS transistor has its source connected to the positive supply node.

* * * * *